US011768469B2

(12) United States Patent
Kaltenrieder et al.

(10) Patent No.: US 11,768,469 B2
(45) **Date of Patent: *Sep. 26, 2023**

(54) WATER-RESISTANT WATCH CASE

(71) Applicant: Omega SA, Biel/Bienne (CH)

(72) Inventors: Cedric Kaltenrieder, Courtelary (CH); Gregory Kissling, La Neuveville (CH); Yves Winkler, Schmitten (CH)

(73) Assignee: Omega SA, Biel/Bienne (CH)

( * ) Notice: Subject to any disclaimer, the term of this patent is extended or adjusted under 35 U.S.C. 154(b) by 646 days.

This patent is subject to a terminal disclaimer.

(21) Appl. No.: 16/846,811

(22) Filed: Apr. 13, 2020

(65) Prior Publication Data

US 2020/0356061 A1 Nov. 12, 2020

(30) Foreign Application Priority Data

May 8, 2019 (EP) ..... 19173326

(51) Int. Cl.
*G04B 39/02* (2006.01)
*G04B 37/08* (2006.01)
*G04B 45/00* (2006.01)

(52) U.S. Cl.
CPC ..... *G04B 39/02* (2013.01); *G04B 37/088* (2013.01); *G04B 45/0084* (2013.01)

(58) Field of Classification Search
CPC ..... G04B 37/08–116; G04B 39/02
See application file for complete search history.

(56) References Cited

U.S. PATENT DOCUMENTS 2,720,748 A * 10/1955 Gisiger ..... G04B 37/082 368/291
2,951,333 A 9/1960 Morf et al.
(Continued)

FOREIGN PATENT DOCUMENTS

CH 217284 10/1941
CH 251697 11/1947
(Continued)

OTHER PUBLICATIONS

Debaud, Nicolas et al., English Translation of EP 3163380, originally published on May 3, 2017, retrieved from Espacenet on Sep. 30, 2022, full document (Year: 2017).*
(Continued)

*Primary Examiner* — Daniel P Wicklund
(74) *Attorney, Agent, or Firm* — Oblon, McClelland, Maier & Neustadt, L.L.P.

(57) ABSTRACT

A water-resistant watch case of a diving watch, includes at least one back mounted on a lower side of a middle part, and a crystal mounted on an upper side of the middle part. The crystal includes an annular peripheral surface to be fastened with an amorphous metal gasket on an inner annular surface that is complementary in shape, on the upper side of the middle part. The annular peripheral surface of the crystal is inclined towards the inside of the watch case at a determined angle less than 90° relative to a central axis perpendicular to a plane of the watch case to distribute stresses between the crystal and the middle part due to the water pressure during a dive. The annular peripheral surface and the inner annular surface are conical in shape.

15 Claims, 4 Drawing Sheets

(56) References Cited

U.S. PATENT DOCUMENTS

| | | | | |
|---|---|---|---|---|
| 3,672,158 | A * | 6/1972 | Fujimori | G04B 37/225 968/366 |
| 4,186,552 | A * | 2/1980 | Ishigaki | G04B 37/081 968/328 |
| 4,668,101 | A * | 5/1987 | Wuthrich | G04B 39/02 368/294 |
| 11,169,488 | B2 * | 11/2021 | Kaltenrieder | F16J 15/0806 |
| 11,449,010 | B2 * | 9/2022 | Kaltenrieder | G04B 39/02 |
| 2008/0025157 | A1 * | 1/2008 | Hiranuma | G04B 39/02 368/294 |
| 2012/0075964 | A1 * | 3/2012 | Hirayama | G04B 39/02 368/281 |
| 2014/0178625 | A1 | 6/2014 | Lauper et al. | |
| 2015/0049593 | A1 * | 2/2015 | Oliveira | B23K 26/06 219/121.69 |
| 2016/0263698 | A1 | 9/2016 | Noirot et al. | |
| 2018/0173166 | A1 * | 6/2018 | Kayano | G04G 17/08 |

FOREIGN PATENT DOCUMENTS

| | | | |
|---|---|---|---|
| CH | 378792 | | 11/1963 |
| CH | 659 561 | A3 | 2/1987 |
| CH | 690 870 | A5 | 2/2001 |
| CN | 201205973 | Y | 3/2009 |
| CN | 101517494 | A | 8/2009 |
| CN | 205375008 | U | 7/2016 |
| EP | 3 067 220 | A1 | 9/2016 |
| EP | 3 163 380 | A1 | 5/2017 |
| EP | 3 181 006 | A1 | 6/2017 |
| GB | 1153764 | | 5/1969 |
| JP | 60-247187 | | 12/1985 |
| JP | 2014-121608 | A | 7/2014 |
| JP | 2016-506264 | A | 3/2016 |
| JP | 2016-70677 | A | 5/2016 |
| LU | 100047 | B1 | 6/2017 |
| WO | WO 99/21061 | A1 | 4/1999 |
| WO | WO 2014/096260 | A1 | 6/2014 |
| WO | WO 2017/071903 | A1 | 5/2017 |

OTHER PUBLICATIONS

Li, Zhong et al., English Translation of CN 201205973 Y, originally published on Mar. 11, 2009, retrieved from Espacenet on Sep. 30, 2022, full document (Year: 2009).*

Russian Office Action dated Nov. 19, 2020 in Russian Patent Application No. 2020115125 (with English translation), 10 pages.

Notice of the Reason for Refusal dated Feb. 9, 2021 in Japanese Patent Application No. 2020-75898 (with English language translation), 10 pages.

European Search Report dated Nov. 20, 2019 in European Application 19173326.0 filed May 8, 2019 (with English Translation of Categories of Cited Documents), 14 pages.

Combined Chinese Office Action and Search Report dated Nov. 17, 2021 in corresponding Chinese Patent Application No. 202010377805.3 (with English Translation and English Translation of Category of Cited Documents), 14 pages.

Combined Chinese Office Action and Search Report dated Mar. 30, 2021 in corresponding Chinese Patent Application No. 202010377805.3 (with English Translation and English Translation of Category of Cited Documents), 13 pages.

* cited by examiner

WATER-RESISTANT WATCH CASE

CROSS-REFERENCE TO RELATED APPLICATION

This application claims priority to European Patent Application No. 19173326.0 filed on May 8, 2019, the entire disclosure of which is hereby incorporated herein by reference.

TECHNICAL FIELD

The present invention relates to a water-resistant watch case, in particular for a diving watch.

TECHNOLOGICAL BACKGROUND

To provide for the use of a mechanical or electronic watch underwater, the watch case, which comprises a horological movement or a time-based horological module, must be sealingly closed. For this purpose, the watch case comprises a back sealingly fastened to a first side of a middle part and a crystal fastened to a second opposite side of the middle part. Packings are provided for the assembly of the back, the middle part and the crystal of the watch. A watch function control or setting member is also sealingly mounted through the middle part of the case in the rest position.

Generally watch cases are not configured or assembled to withstand high water pressures, for example during a dive since the pressure inside the watch case is close to atmospheric pressure. Simple packings of traditional watches are not enough to guarantee a good water resistance of the case during a dive to very large depths underwater.

Mention may be made of the patent application CH 690 870 A5 which describes a water-resistant watch case. The watch case consists of a crystal fastened on an upper side to a middle-bezel and a back fastened to the middle part by screwing it to an internal tapping of the middle part. The crystal is fastened to the middle part by an annular packing of a toroidal shape and bearing on a rim of the middle part. A packing is also provided between an outer rim of the back and a lower surface of the middle part. As the tapping can be damaged at high water pressure, a dome made of a resistant metal is also provided, bearing against an inner surface of the back and against an inner edge of the middle part. However, even with such a watch case arrangement, this does not allows guaranteeing a good water-resistance of the case during a dive to very large depths underwater, which constitutes a disadvantage.

The patent CH 372 606 describes a water-resistant watch case, which has a central portion or middle part surrounding a back and closed by a crystal. A threaded ring is bearing against an inclined outer surface of the back to retain it, and is screwed to a fastening portion connected to the middle part. With such an arrangement presented, this does not allow guaranteeing a good water-resistance of the case during a dive to very large depths underwater, which constitutes a disadvantage.

SUMMARY OF THE INVENTION

Therefore, the main purpose of the invention is to overcome the disadvantages of the prior art described above by proposing a water-resistant watch case adapted to withstand the high water pressure for diving to large depths under water.

To this end, the present invention relates to a water-resistant watch case.

An advantage of the water-resistant watch case lies in the fact that the crystal is fastened to the middle part by means of a one-piece metal gasket and with inclined contact surfaces of the middle part and the crystal.

The metal fastening gasket has a shape that complements the fastening surfaces before the operation of fastening the crystal to the middle part. In the case of a generally cylindrical middle part, conical bearing surfaces are provided on the crystal and the middle part, or also on the back mounted on an opposite side of the middle part. In this way, pressure forces on the crystal and the back are transmitted to the middle part via conical bearing surfaces, and by way of the one-piece metal gasket.

Advantageously, in the case of a one-piece gasket made of amorphous metal, the fastening of the crystal to the middle part by way of the fastening gasket can in particular take place by hot working. This prevents the concentrations of stresses, provides the crystal with high strength and creates a very good seal for the watch case.

Advantageously, during the operation of fastening the crystal to the middle part, the heated amorphous metal gasket is in a softened state so as to be properly applied to the contact surface of the crystal and the contact surface of the middle part while filling any interstice in the finish of each contact surface. Moreover, when cooling the crystal fastened to the middle part, the amorphous metal gasket acts as a stress interface between the middle part and the crystal since the thermal expansion coefficient of the middle part, which is made of titanium for example, is greater than that of the crystal, which is made of sapphire for example.

BRIEF DESCRIPTION OF THE FIGURES

The purposes, advantages and features of a water-resistant watch case will appear better in the following description in a non-limiting manner with reference to the drawings wherein.

DETAILED DESCRIPTION OF THE INVENTION

In the following description, all the components of a case of a water-resistant watch, in particular a diving watch, which are well known to a person skilled in the art in this technical field are only stated in a simplified manner.

Figure 1A:
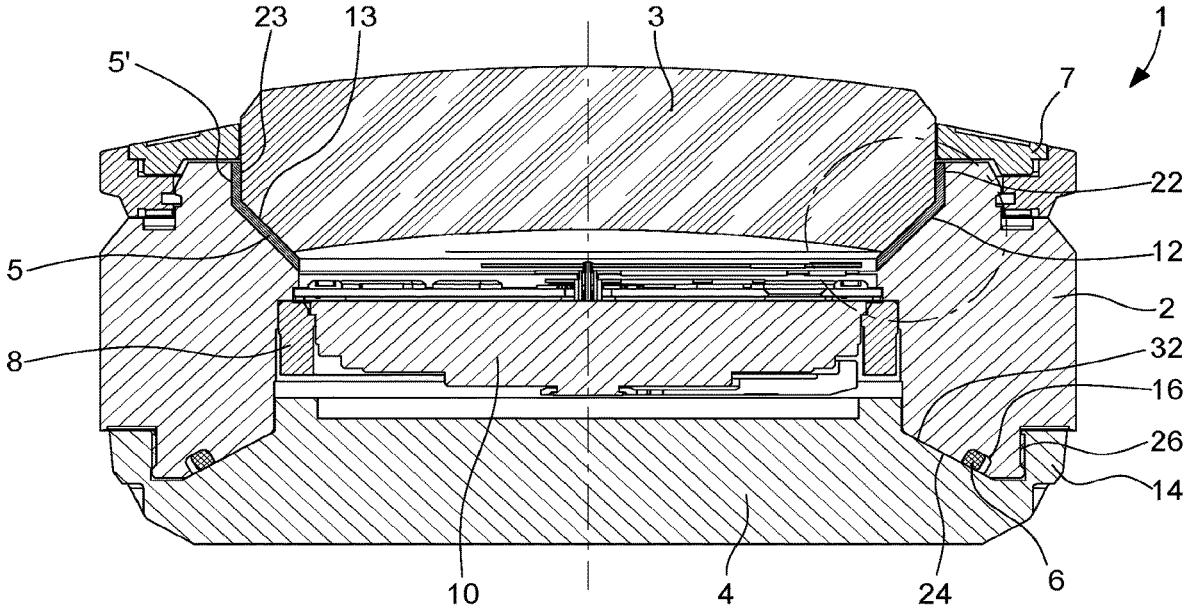
FIGS. 1*a* and 1*b* show in a simplified manner a cross-section of one embodiment of a watch with a water-resistant case according to the invention, and a partial detail section of the fastening of the crystal to the middle part according to the invention.
Figure 1B:
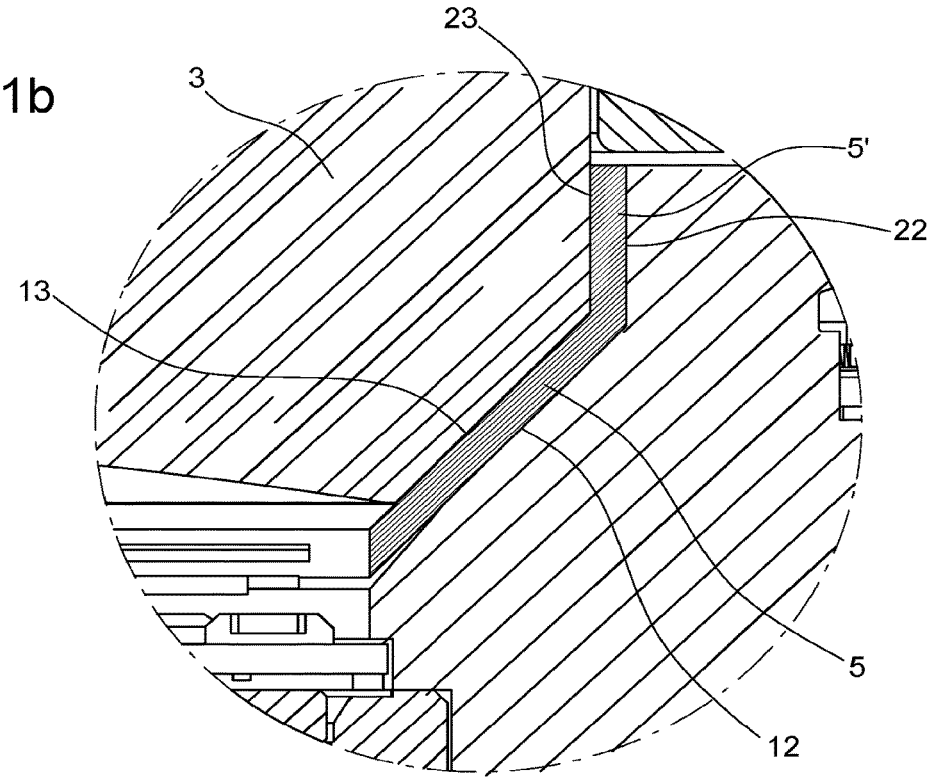

FIGS. 1*a* and 1 *b* show one embodiment of a watch case 1, which can be used for a diving watch. The watch case 1 essentially comprises a crystal 3, which can be made of sapphire or mineral crystal, fastened on an upper side of a middle part 2, and potentially a back 4 mounted on a lower side of the middle part 2. A bezel 7 can also be mounted on the upper side of the middle part 2. A horological movement or module 10 is disposed in the watch case 1 in a casing circle 8, and at least one control member, not shown, can be sealingly mounted in a rest position on or through the middle part 2 for setting the time, the date or other functions of the diving watch.

In the case where a back 4 of the watch case 1 is provided, the solid back 4 can comprise an annular rim 14 with internal tapping so as to be screwed onto a tapping 26 on the lower side of the middle part 2. An annular bearing surface 24 of the back 4 comes into contact with an inner annular surface 32 of the middle part 2 of a shape complementary to the bearing surface 24 when mounting the back 4 on the middle part 2. The bearing 24 and inner 32 surfaces are inclined at a determined angle relative to an axis perpendicular to a plane of the watch case 1. In the case of a middle part of a generally cylindrical shape, the surfaces 24, 32 are conical in shape and are inclined towards the inside of the watch case 1 at a determined angle relative to a central axis of the watch case 1. This means that the top of each cone shape is in the direction of the inside of the watch case 1. The lower side of the middle part 2 also comprises an annular groove 16 housing a packing 6 of a toroidal shape in contact with the bearing surface 24 when the back 4 is mounted on the middle part 2. For a middle part 2 and a back 4, made of a material, such as titanium, the angle can be of the order of 60°±5° relative to the central axis. This allows having a good stress distribution between the back 4 and the middle part 2 due to the water pressure during a dive to large depths underwater.

The crystal 3 comprises an annular peripheral surface 13 to be fastened by means of a one-piece metal fastening gasket 5, 5' on an inner annular surface 12 on the upper side of the middle part 2. The inner annular surface 12 is preferably of a shape complementary to the annular peripheral surface 13. The gasket 5, 5', as an interface between the middle part 2 and the crystal 3, can also be produced before the fastening operation in a shape that complements the contact surfaces of the crystal 3 on the middle part 2. The annular peripheral surface 13 of the crystal 3 is inclined at a defined angle less than 90° relative to an axis perpendicular to a plane of the watch case 1. Preferably, the inner annular surface 12 is inclined generally towards the inside of the watch case 1 at the same angle as the annular peripheral surface 13 relative to a central axis.

If the middle part 2 is of a generally cylindrical shape, the inner peripheral surface 13 and the inner annular surface 12 are conical in shape and inclined at a defined angle towards the inside of the watch case. This means that the top of each cone shape is in the direction of the inside of the watch case 1. The defined angle of inclination of the surfaces 12 and 13 can be of the order of 43°±5° relative to the central axis. This allows having a good stress distribution between the crystal 3 and the middle part 2 due to the water pressure during a dive to large depths underwater. The difference in water pressure compared to the pressure inside the watch case 1 tends to close any interstice that remains between the surfaces 12, 13 in contact and the fastening gasket 5, 5' thanks to the inclination of the contact surfaces towards the inside of the watch case 1. This guarantees a good water-resistance and withstanding to high pressures.

In this embodiment, the one-piece metal fastening gasket 5, 5' is made of amorphous metal or metallic glass or amorphous metal alloy. It can comprise a first portion 5 and a second portion 5'. The fastening gasket 5, 5' is of an annular shape for the hermetic closure of the crystal 3 on the middle part 2. For a middle part 2 of a generally cylindrical shape, the first portion 5 of the gasket is conical in shape, while the second portion 5' is cylindrical. Once the crystal 3 is fastened on the middle part 2, the first portion 5 is fastened to the inclined surfaces of the middle part 2 and of the crystal 3, while the second portion 5' is fastened to an inner annular wall 22 of the middle part 2 and an outer annular wall 23 of the crystal 3 above the annular peripheral surface 13 of the crystal 3. The second portion 5' can stop at mid-height of the crystal 3 just below the bezel 7, while the first portion 5 of the gasket can extend below the level of the link between the bottom of the crystal 3 and the middle part 2.

In a non-limiting manner, the length of the first portion 5 in cross-section can be of the order of 5 mm, while the height of the second portion of the gasket 5, 5' can be of the order of 2.5 mm. The thickness of the gasket can be of the order of 0.65 mm.

Normally, the one-piece metal fastening gasket 5, 5' of annular shape is made of amorphous metal alloy so as to fasten the crystal 3 to the middle part 2, for example by hot working. When fastening the crystal 3 to the middle part 2, the space between the crystal 3 and the middle part 2 is sought to be completely filled. Thus, by means of this hot working of the gasket while pressing the crystal 3 onto the middle part 2, the finish of the contact surface of the crystal 3 and of the contact surface of the middle part 2 is replicated by the heat-softened gasket. A certain roughness can thus be considered at the annular peripheral surface 13 of the crystal 3, that is sufficient to provide for better adherence of the gasket 5, 5' to the crystal 3 and to the middle part 2. In this manner, the heat-softened amorphous metal gasket perfectly takes on the finish of the crystal 3 and of the middle part 2, which guarantees a good sealed closure.

Moreover, the metal further compensates for a potential angle error between the conical surface of the crystal 3 and the conical surface of the middle part 2, and thus ensures that the crystal 3 perfectly bears against the middle part 2, which significantly reduces stress concentrations during pressurisation. This is very important since the crystal 3 is generally made of a fragile material such as sapphire or mineral glass. Thus, a very localised contact of the crystal 3 on the middle part 2 could cause breakage when being pressurised under water.

As explained hereinabove, the gasket 5, 5' made of amorphous metal acts as an interface between the middle part 2 and the crystal 3. During the operation for fastening, under heat, the crystal 3 to the middle part 2 by means of the heat-softened gasket 5, 5', this gasket also serves to accumulate stresses during the cooling operation. This is important since the thermal expansion coefficient of the middle part 2 made of titanium is greater than that of the contact surface of the crystal 3 made of sapphire.

Several types of amorphous metal alloys can be used to make the entire one-piece metal gasket 5, 5'. In the most frequent cases, the amorphous metal alloy can be mainly composed of zirconium, which allows forming the gasket at a temperature higher than 350° C., that is to say higher than the glass transition temperature of the alloy. The zirconium-based amorphous metal alloy can be composed of Zr(52.5%), Cu(17.6%), Ni(14.9%), Al(10%) and Ti(5%). The zirconium-based amorphous metal alloy may also comprise Zr(58.5%), Cu(15.6%), Ni(12.8%), Al(10.3%) and Nb(2.8%). The zirconium-based amorphous metal alloy may also comprise Zr(44%), Ti(11%), Cu(9.8%), Ni(10.2%) and Be(25%), or finally Zr(58%), Cu(22%), Fe(8%) and Al(12%). Preferably, to facilitate the production of such a gasket, the amorphous metal alloy can be mainly composed of platinum (Pt), which allows the gasket to be formed at a temperature above 230° C. The platinum-based amorphous metal alloy may comprise Pt(57.5%), Cu(14.7%), Ni(5.3%) and P(22.5%). It is also possible to provide for making the one-piece metal gasket 5, 5' of an amorphous metal alloy based mainly on palladium (Pd), which allows forming the gasket at a temperature above 300° C.

Other alloys of amorphous metals can also be mentioned. A titanium-based amorphous metal alloy may comprise Ti(41.5%), Zr(10%), Cu(35%), Pd(11%) and Sn(2.5%). A palladium-based amorphous metal alloy may comprise Pd(43%), Cu(27%), Ni(10%) and P(20%), or Pd(77%), Cu(6%) and Si(16.5%), or finally Pd(79%), Cu(6%), Si(10%) and P(5%). A nickel-based amorphous metal alloy may comprise Ni(53%), Nb(20%), Ti(10%), Zr(8%), Co(6%) and Cu(3%), or Ni(67%), Cr(6%), Fe(4%), Si(7%), C(0.25%) and B(15.75%), or finally Ni(60%), Pd(20%), P(17%) and B(3%). An iron-based amorphous metal alloy may comprise Fe(45%), Cr(20%), Mo(14%), C(15%) and B(6%), or Fe(56%), Co(7%), Ni(7%), Zr(8%), Nb(2%) and B(20%). A gold-based amorphous metal alloy may comprise Au(49%), Ag(5%), Pd(2.3%), Cu(26.9%) and Si(16.3%).

The production of such a gasket 5, 5' made of amorphous metal can be done by different shaping methods, namely:

- directly from the molten metal such as, for example, pressure injection, gravitational casting, centrifugal casting, anti-gravitational casting, suction casting, additive powder manufacturing,
- from amorphous preforms by hot deformation above the glass transition temperature such as for example, electromagnetic forming, forming by capacitive discharge, forming under gas pressure, mechanical forming. The objective of this step is to obtain a preform having the correct dimensions and having enough proportion of amorphous phase to allow its deformation during the assembly step described below.

Figure 2A:
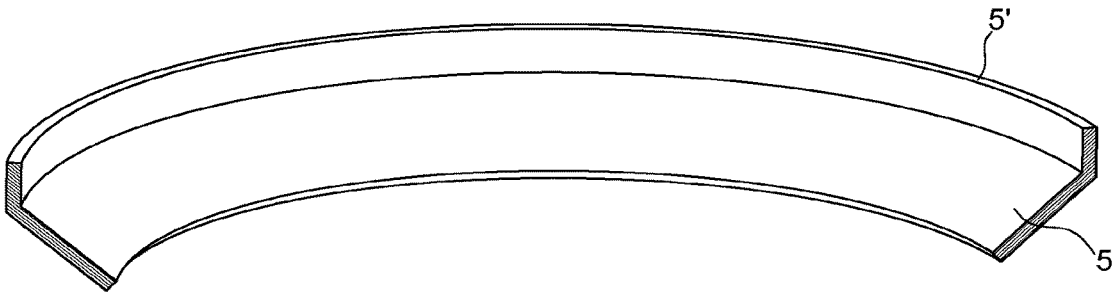
FIGS. 2*a* to 2*c* show a partial three-dimensional section view of a fastening gasket and different steps for fastening the crystal to the middle part by way of the fastening gasket of the watch case according to the invention.

The annular fastening gasket with the first portion 5 that is conical in shape and the second portion 5' that is cylindrical in shape is shown by way of a partial three-dimensional section view in FIG. 2*a*. This gasket form made of two portions 5, 5' is used to fasten the crystal 3 to the middle part 2 as shown in FIGS. 2*b* and 2*c*.

Figure 2B:
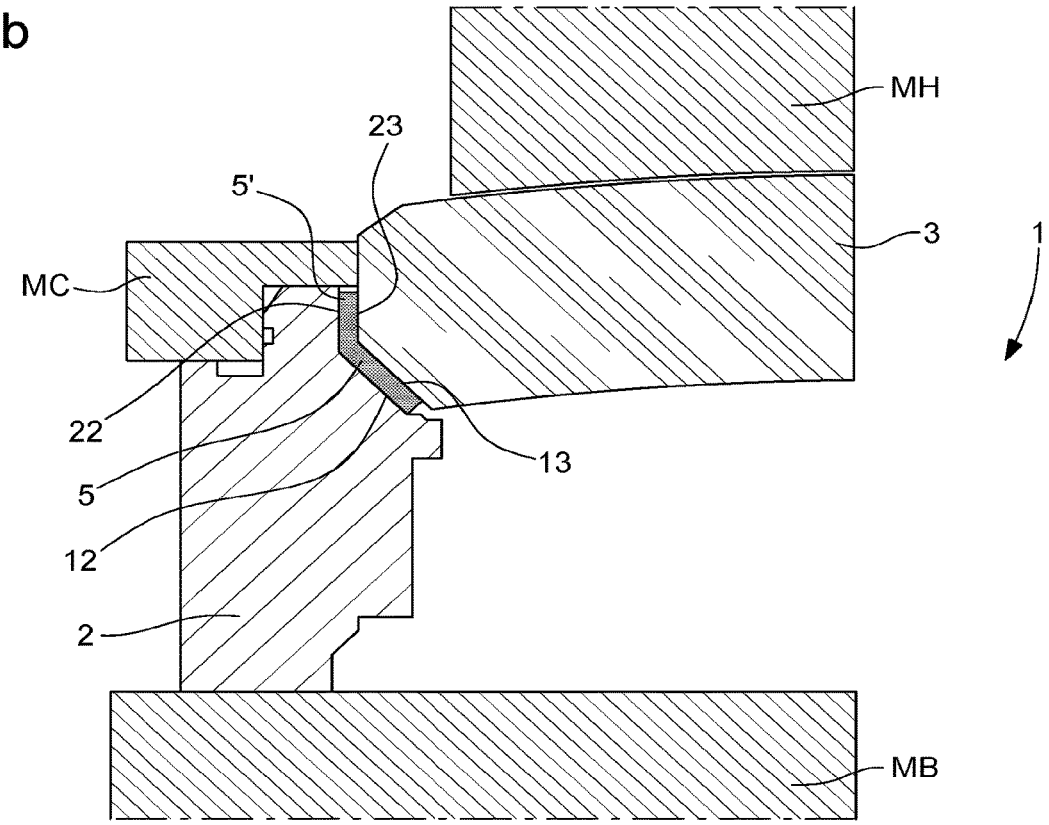
Figure 2C:
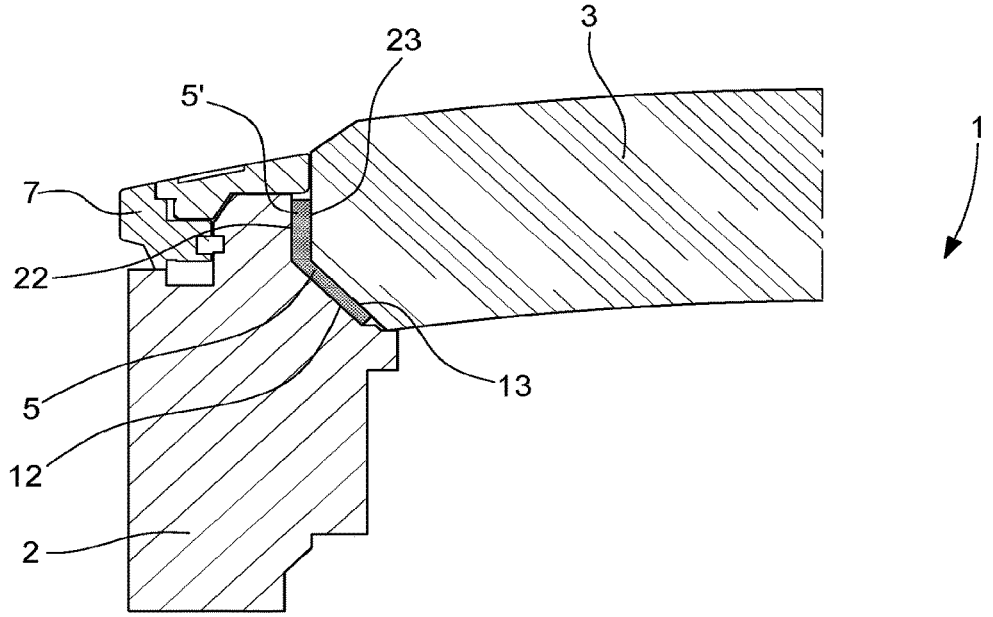

In FIG. 2*b*, the gasket 5, 5' is firstly placed on the upper side of the middle part 2. The first portion 5 of the gasket is in contact with the inner annular surface 12, whereas the second portion 5' is close to the inner annular wall 22 of the middle part 2. The crystal 3 is then mounted on the gasket 5, 5'. The annular peripheral surface 13 of the crystal 3 is in contact with the first portion 5 of the gasket, whereas the outer annular wall 23 of the crystal 3 above the annular peripheral surface 13 is close to the second portion 5' of the gasket. In this manner, the gasket 5, 5' is disposed between the middle part 2 and the crystal 3.

In order to fasten the crystal 3 to the middle part 2 by means of a gasket 5, 5' made entirely of amorphous metal alloy, an overlap prevention tool MC is placed on the upper side of the middle part 2 and in contact with the outer annular wall 23 of the crystal 3. The purpose of this overlap prevention tool MC is to prevent the amorphous metal alloy of the gasket from exiting from the upper side of the middle part 2. Another overlap prevention tool, not shown, can also be provided beneath and on the inner side of the watch case to prevent the amorphous metal alloy of the gasket from exiting from the lower side. A top tool MH presses the crystal 3 towards the middle part 2, whereas a bottom tool MB supports the lower side of the middle part 2.

With a zirconium-based amorphous metal alloy for the gasket, a pressure of about 10,000 to 80,000 N is used to apply the crystal 3 against the middle part 2 at a temperature of about 480° C. for a period of 30-250 seconds. Thus, the pressure exerted by the sapphire 3 on the portion 5 of the gasket causes creep in the material contained in the portion 5 of the gasket towards the portion 5' and downwards. The consequences are a downwards displacement of the crystal 3 and a thinning of the portion 5 of the gasket until the gasket completely fills the space located between the middle part 2, the overlap prevention tool MC, the inner overlap prevention tool and the crystal 3. The amorphous metal gasket will, during the creep thereof, mould all of the details of the surfaces 12, 13, 22 and 23. When cooling the assembly at the end of the gasket deformation step, the dimensions of the middle part 2, of the gasket 5, 5' and of the crystal 3 will seek to proportionately reduce to the respective expansion coefficients $\alpha$ thereof. However, the crystal 3 (for example made of sapphire where $\alpha$=5 to 8 ppm) has an expansion coefficient that is less than those of the middle part 2 (for example: $\alpha$=8.5 to 11 ppm for titanium, 12 to 18 ppm for stainless steel, 12 to 16 for gold) and of the gasket 5, 5' made of amorphous metal ($\alpha$=9 to 18 ppm). This generates a force compressing the middle part 2 and the gasket 5, 5' made of amorphous metal against the crystal 3 at the second portion 5' of the gasket which is cylindrical. This compression ensures both very high strength and very good sealing of the assembly at ambient temperature.

Moreover, the specific mechanical properties of the amorphous metals, in particular the very high yield strength $\sigma_e$ thereof (for example: 1,700 MPa for a Zr base; 1,550 MPa for a Pd base; 1,350 MPa for a Pt base) coupled with a very high elastic deformation $\varepsilon_e$ (1.5 to 2% for all amorphous metals), prevent the plasticising of the gasket 5, 5' in the contact area thereof with the crystal 3 when being stressed under very high pressures. The middle part 2, whose mechanical properties (for example for grade 5 titanium: $\sigma_e$ 850 MPa; $\varepsilon_e$ 0.5 to 0.8%) are inferior to those of the amorphous metals selected for the gasket, also does not plasticise since the gasket 5, 5' made of amorphous metal allows the stresses to be homogenised, which stresses are thus reduced at the gasket—middle part interface.

For an amorphous metal alloy mostly composed of palladium, the fastening of the crystal 3 to the middle part 2 by means of the gasket 5, 5' takes place at a temperature of the order of 380° C. while applying a pressure of about 10,000-80,000 N for 30-250 seconds.

For an amorphous metal alloy mostly composed of platinum, the fastening of the crystal 3 to the middle part 2 by means of the gasket 5, 5' takes place at a temperature of the order of 280° C. while applying a pressure of about 10,000-80,000 N for 30-250 seconds.

As described hereinabove, stresses are generated in the crystal 3 during cooling because of the differences in expansion coefficients between the middle part 2 and the crystal 3. These forces depend on the geometrical configuration of the assembly, the materials chosen (middle part, amorphous metal, crystal) and the temperature used during assembly. Although these stresses are useful to ensure the strength and sealing of the assembly, they can cause the crystal to break if they are too high or too localised. This is why it is important to select a suitable amorphous metal in order to prevent this problem. More specifically, the use, for example, of a Pt-based amorphous metal allows these forces to be reduced since the temperature of the assembly method will be low (about 280° C.) and thus the differential retraction of the middle part 2 relative to the crystal 3 will be low.

Another means of reducing the stresses in the crystal 3 after the assembly method, as described hereinabove, involves partially or fully crystallising the gasket 5, 5' made of amorphous metal. More specifically, crystallisation generates a reduction in the volume of the amorphous metal and thus of the gasket 5, 5', which slightly detaches the middle part-gasket and gasket-crystal contact surfaces. During cooling, the differential retraction of the middle part 2 must firstly compensate for the void left by the crystallisation of the amorphous metal before beginning to clamp against the crystal 3. The residual stresses ultimately present in the sapphire are lower relative to a 100% amorphous gasket.

The crystallisation of the gasket 5, 5' can take place by maintaining the temperature of the assembly for an extended period after the working phase. For example, for the case of a zirconium-based alloy, maintenance at 480° C. for 5 minutes can generate crystallisation of the gasket. The temperature can also be increased by 20° C. to 100° C. after the creep phase in order to accelerate crystallisation or change the nature thereof (different crystalline phases). The temperature can also be reduced after the creep phase to obtain slower and finer crystallisation.

FIG. 2*c* shows the outcome of the fastening of the crystal 3 on the middle part 2 after having removed the tools used therefor. A bezel 7 covers the upper side of the middle part 2. The first portion 5 of the gasket rigidly connects the annular peripheral surface 13 of the crystal 3 to the inner annular surface 12 of the middle part 2. The second portion 5' of the gasket rigidly connects the inner annular wall 22 of the middle part 2 and the outer annular wall 23 of the crystal 3. Normally, the first portion 5 of the gasket extends below the level of the link between the bottom of the crystal 3 and the middle part 2, which thus does not comprise the inner beak shown in FIGS. 2*b* and 2*c*.

Figure 3:
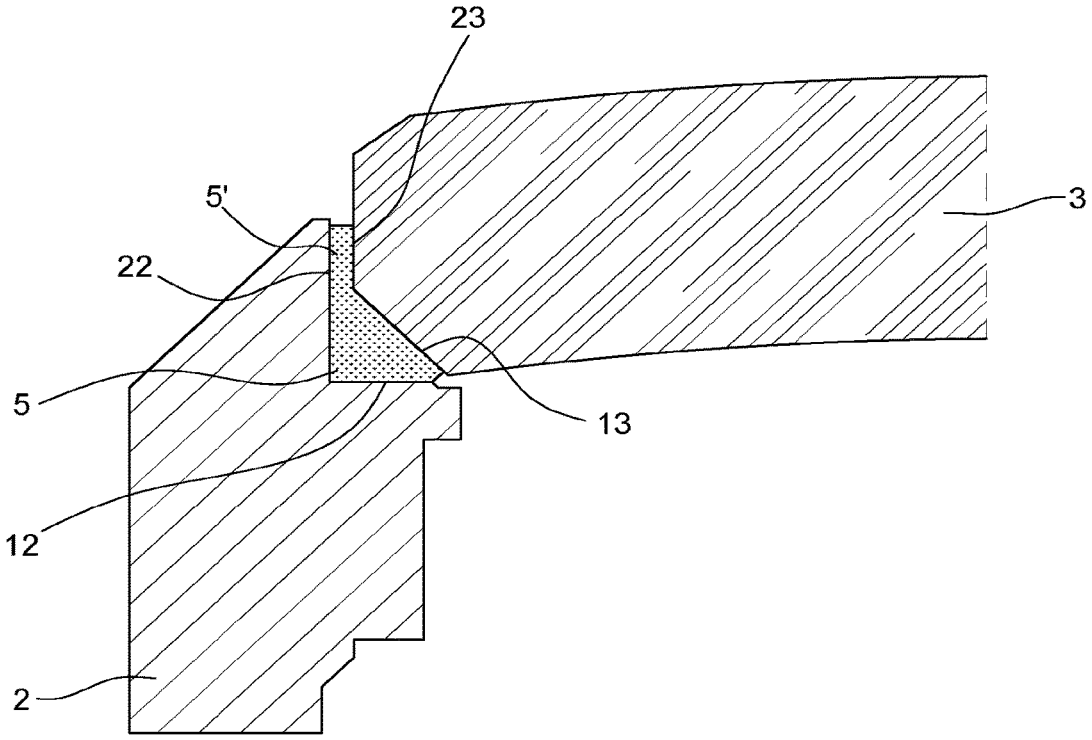
FIG. 3 shows a partial detail section view of one variant for the fastening of the crystal to the middle part according to the invention, FIG. 4 diagrammatically shows an overhead view of one embodiment of a watch case according to the invention.

FIG. 3 shows a partial detail section of one variant for the fastening of the crystal 3 to the middle part 2. The crystal 3 comprises an annular peripheral surface 13 to be fastened by means of a one-piece metal fastening gasket 5, 5' on an inner annular surface 12 on the upper side of the middle part 2. Although the middle part 2 is cylindrical overall, the inner peripheral surface 13 of the crystal 3 is conical in shape, whereas the inner annular surface 12 of the middle part 2 is in the plane of the watch case 1 in the shape of a portion of a disc. The first portion 5 of the gasket is between the inner peripheral surface 13 and the inner annular surface 12, whereas the second portion 5' of the gasket is between the inner annular wall 22 of the middle part 2 and the outer annular wall 23 of the crystal 3.

Figure 4:
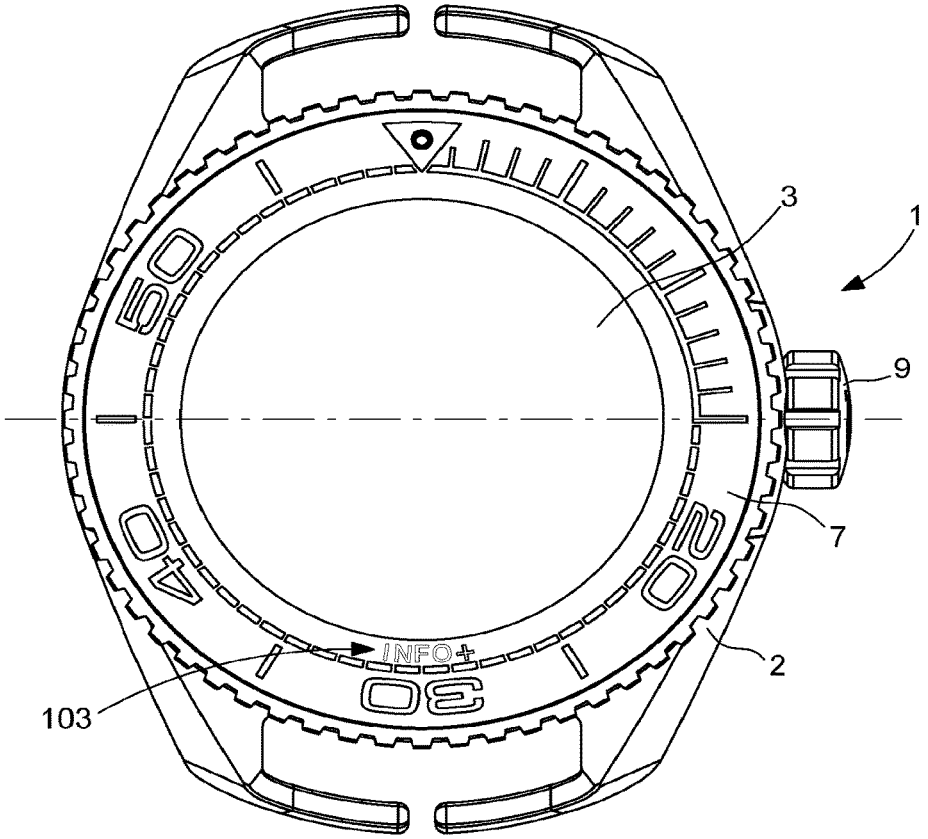

FIG. 4 diagrammatically shows an overhead view of one embodiment of a watch case 1. The watch case 1 comprises the middle part 2, the crystal 3, a bezel 7 and a control member 9 in the form of a stem-crown passing through the middle part 2. The stem-crown comprises a conical surface, not shown, in contact with a conical inner surface of the middle part 2 in the rest position to ensure the water-tight seal and ability to withstand the water pressure during a dive. An inscription 103 of a word or a number or drawings is made at the connection between the annular peripheral surface 13 of the crystal 3 and the first portion of the fastening gasket.

Figure 5A:
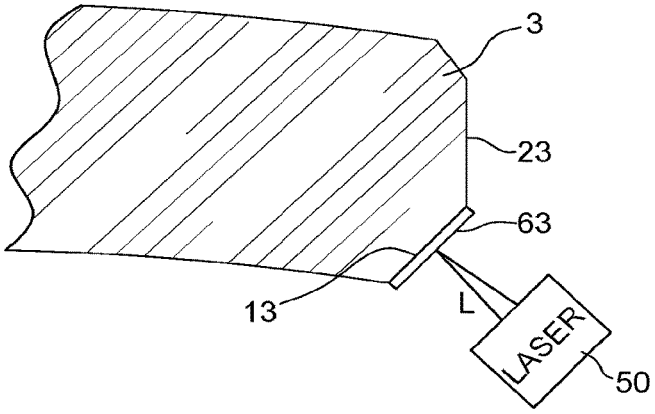
FIGS. 5*a* and 5*b* show a crystal with a metal coating capable of being etched by a laser to produce an inscription on the surface for fastening the crystal to the middle part, and a portion of the metal coating on the crystal with the inscription according to the invention.
Figure 5B:
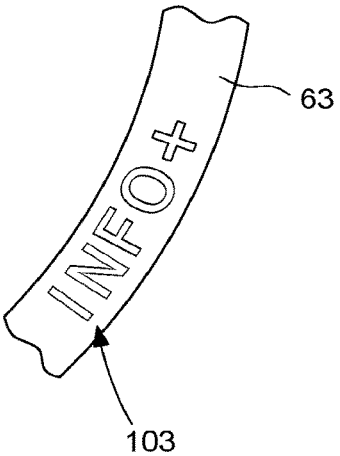

As shown in FIGS. 5*a* and 5*b*, to produce the inscription 103, a structured contact surface of the crystal 3 can also be provided and/or a decorative layer can also be deposited on the surface thereof. This structuring and/or deposit 63 can be disposed on the annular peripheral surface 13 of the crystal 3. One or more words, or numbers or drawings can also be written by etching the deposit 63 by means of a laser beam L originating from a laser device 50. The deposit 63 can have a different colour to that of the first portion of the fastening gasket. As a result, after the etching of the inscription 103 on the deposit 63, the annular peripheral surface 13 of the crystal 3 can be placed or fastened onto the first portion of the fastening gasket, which has a colour different to that of the deposit 63.

A pattern can also be created on the contact surface of the crystal 3 by selective structuring of the surface thereof. The surface can be structured, for example, by a laser, by a chemical method or even by a mechanical method (for example grinding or milling). Thus, once the crystal 3 has been fastened to the middle part 2, the inscription produced can be read through the crystal 3, which can also indicate the brand of the watch.

It should also be noted that with the fastening of the crystal 3 on the middle part 2 of the variant embodiments described above and with the contact of conical surfaces between the crystal 3 and the middle part 2, a good water-resistance and a good stress distribution between the crystal 3 and the middle part 2 are guaranteed. This is necessary since the watch is a diving watch which must withstand high stresses due to the pressure difference between the inside of the watch and the water pressure in large depths underwater. As the contact surface between the middle part 2, the gasket 5, 5' and the crystal 3 is quite large with this conical shape, there is a better transmission of stresses over a larger area, which is important to reduce the stress concentrations in the crystal and thus prevent the breakage thereof when diving deep underwater. This also ensures the water-resistance of the watch case. With this arrangement, the water pressure on the watch case tends to close any interstice between the contact surfaces. In addition, this prevents the extrusion of the fastening gasket.

From the description which has just been made, several alternative embodiments of the watch case can be designed by a person skilled in the art without departing from the scope of the invention defined by the claims. The watch case by its middle part may have a general shape different from a cylinder.

What is claimed is:

1. A water-resistant watch case for a diving watch, the case comprising:

at least one crystal mounted on an upper side of a middle part, a bezel positioned above the middle part, wherein the crystal comprises an annular peripheral surface to be fastened by a metal gasket of the watch case, that is annular in shape, on an inner annular surface on the upper side of the middle part, wherein the annular peripheral surface of the crystal is inclined towards the inside of the watch case at a determined angle less than 90° relative to a central axis perpendicular to a plane of the watch case in order to distribute stresses between the crystal and the middle part due to the water pressure during a dive, wherein the metal gasket is one piece that includes a first portion arranged between the annular peripheral surface of the crystal and the inner annular surface of the middle part, and a second portion in contact between an inner annular wall of the middle part above the inner annular surface and an outer annular wall of the crystal above the annular peripheral surface, the first portion and the second portion of the metal gasket are linear and are directly connected at a bottom end of the second portion and a top end of the first portion, and wherein a top end of the second portion is positioned below the bezel.

2. The watch case according to claim 1, wherein the one-piece metal gasket is made of metal alloy that is at least partially amorphous in a phase during which the crystal is fastened to the middle part.

3. The watch case according to claim 2, wherein the crystal is fastened to the middle part by the one-piece metal gasket made of metal alloy that is at least partially amorphous after hot working.

4. The watch case according to claim 1, wherein the one-piece metal gasket is made of a metal alloy that is at least partially amorphous.

5. The watch case according to claim 4, wherein the amorphous metal alloy of the gasket is based mainly on zirconium.

6. The watch case according to claim 4, wherein the amorphous metal alloy of the gasket is based mainly on platinum.

7. The watch case according to claim 4, wherein the amorphous metal alloy of the gasket is based mainly on palladium.

8. The watch case according to claim 1, wherein the inner annular surface on the upper side of the middle part is of a shape complementary to the annular peripheral surface of the crystal.

9. The watch case according to claim 1, wherein the annular walls are parallel to the central axis.

10. The watch case according to claim 1, wherein the annular peripheral surface of the crystal and the inner annular surface of the middle part are conical surfaces, wherein the inner annular wall of the middle part and the outer annular wall of the crystal are cylindrical surfaces.

11. The watch case according to claim 1, wherein the defined angle of inclination of the annular peripheral surface of the crystal is of the order of 43°±5° relative to the central axis.

12. The watch case according to claim 1, wherein the defined angle of inclination of the annular peripheral surface of the crystal and the inner annular surface of the middle part is of the order of 43°±5° relative to the central axis.

13. The watch case according to claim 1, wherein the annular peripheral surface of the crystal comprises a deposit for etching an inscription by laser beam.

14. The watch case according to claim 13, wherein a colour of the deposit is different from a colour of a first portion of the fastening gasket so as to view the inscription through the crystal from outside the watch case.

15. The watch case according to claim 1, wherein the annular peripheral surface of the crystal comprises a structuring intended to create a decoration.

* * * * *